United States Patent [19]

Watkins

[11] 4,403,658

[45] Sep. 13, 1983

[54] MULTILINE RISER SUPPORT AND CONNECTION SYSTEM AND METHOD FOR SUBSEA WELLS

[75] Inventor: Bruce J. Watkins, Palos Verdes Estates, Calif.

[73] Assignee: Hughes Tool Company, Houston, Tex.

[21] Appl. No.: 183,881

[22] Filed: Sep. 4, 1980

[51] Int. Cl.[3] ..... E21B 19/09

[52] U.S. Cl. ..... 166/355; 175/7; 166/367

[58] Field of Search ..... 285/26, 29, 137 R, 140; 166/343, 367, 348, 355, 340, 352, 368; 175/7

[56] References Cited

U.S. PATENT DOCUMENTS

| | | | |
|---|---|---|---|
| 3,551,005 | 11/1970 | Brun | 285/137 R |
| 3,791,442 | 2/1974 | Watkins | 285/18 |
| 3,840,071 | 10/1974 | Baugh | 285/26 |
| 3,858,401 | 1/1975 | Watkins | 175/7 |
| 3,952,526 | 4/1976 | Watkins | 285/226 |
| 3,984,990 | 10/1976 | Jones | 175/7 |
| 4,059,148 | 11/1977 | Blomsma | 166/359 |
| 4,109,712 | 8/1978 | Regan | 166/340 |
| 4,142,584 | 3/1979 | Brewer | 175/7 |

*Primary Examiner*—William F. Pate, III

*Attorney, Agent, or Firm*—Robert A. Felsman; Guy Porter Smith

[57] ABSTRACT

A support and connecting system for a multiline riser which joins a floating platform to a subsea well is shown including a support housing which mounts upon the floating platform for disconnectably mounting a termination housing to which a plurality of lines are connected. The termination housing is also connected to the platform by a cable tensioning system which adjusts the tension within its connecting cables. A termination head fits within the termination housing and connects, through a termination riser adapter, to the uppermost riser of a riser run that communicates between the platform and the subsea well. The arrangement permits the riser run to engage the floating platform during assembly and recovery of the risers. In the event of a storm or other need for emergency disconnection, the riser run may be withdrawn from the termination housing and hung off or recoved without disconnecting the lines. During production operations, the riser run floats free of the platform connected thereto solely by the multilines and tensioning system. During drilling operations, a telescoping joint connects the termination housing to the support housing.

15 Claims, 10 Drawing Figures

MULTILINE RISER SUPPORT AND CONNECTION SYSTEM AND METHOD FOR SUBSEA WELLS

BACKGROUND OF THE INVENTION

The present invention relates to a subsea well installation and, more particularly, to a multiline riser support and connection system which operates in engagement with or detachment from a floating platform.

Conventionally, in subsea well drilling and production operations, a floating platform or vessel on the surface of the sea is connected to a subsea well head by a riser run. The riser run may be either a drilling or production run and is comprised of a plurality of riser sections assembled by supporting the uppermost portion of a riser section and subsequently adding riser sections and lowering the assembled riser sections until the desired overall length is reached.

In such operations, a spider may be used which is disposed above a rotary table mounted on the vessel. The spider is opened to encircle the riser thus permitting it to be lowered through the spider. The spider is then closed to support the riser section upon the table by means of a flange on the uppermost end of each riser section. Each new riser section is added to the uppermost section of the spider supported riser run by means of a derrick, or the like, mounted on the vessel which lifts a new riser section over the assembled riser run and lowers it upon the top of the riser run where the flange of the newly positioned riser is bolted or otherwise secured to the flange of the uppermost portion of the assembled riser. The weight of the riser run is then lifted by the derrick, the spider is opened, and the assembled risers or lowered into the sea to repeat the operation.

During such operations, it is desirable to maintain a constant load on the riser run regardless of the motion of the vessel or platform. An example of a hydraulically operated gimbal system which supports the table that, in turn, supports the run is shown in U.S. Pat. No. 3,984,900, issued Oct. 12, 1976.

As each riser section is lowered into the sea, its weight is supported to a substantial extent by gas entrapped between the outer surface of the cylindrical wall which forms the inner tube of the riser and the inner surface of a cylindrical shell which forms the outer cover of the riser. This entrapped gas contributes to the buoyancy of the riser as described in greater detail in U.S. Pat. No. 3,858,401, issued Jan. 7, 1975. The inner tube formed by the cylindrical wall may be used for a clearance passageway for drilling tools attached to an operating string when the riser run is used for drilling operations or as a passageway through which the production of the well is brought to the surface during the production operation.

Once the riser run has been landed on the well head and connection is made with the well head connector, as shown in U.S. Pat. No. 4,109,712, issued Aug. 29, 1978, the vertical motion of the floating platform or vessel must be absorbed to prevent the riser run from crushing under its own weight. An example of a telescoping joint used on buoyant riser sections to absorb the motion of a vessel is shown in U.S. Pat. No. 3,952,526, issued Apr. 27, 1976.

The telescoping joint which compensates for the vertical movement of the floating platform may be located at either the lower end of the riser string adjacent the well head or the upper end of the riser string adjacent the platform. When the telescoping joint is located at the upper end of the riser run adjacent the vessel, the run is dynamically hung from cables attached from the lower surface of the platform or vessel to a point below the telescoping joint. Winches are provided on the cables to retain a constant tension and prevent the riser run from buckling under its own weight. An example of such a tensioning system is shown in U.S. Pat. No. 3,791,442, issued Feb. 12, 1974.

In all of the systems described above, the multilines or hoses connected between the floating platform or vessel and the riser run which are ultimately connected to the well head must pass from the vessel to the uppermost riser and connect thereto by threaded connectors or other suitable means. These lines include flow lines, injection lines, and sales lines when the drill rig is being operated in the production phase. In the drilling operation, the lines include supply and return lines for a hydraulic drilling fluid, commonly called mud, and choke and kill lines for blowout protection. An example of a blowout-preventer used in an upper most riser of a drilling riser run is shown in the U.S. Pat. No. 3,791,442 patent.

While a floating platform generally operates in quiescent seas, clearly the platform or vessel will be subjected to storms during some of its drilling or production operation. At this time, the operation is terminated and the riser run is withdrawn from the well head. The run is then attached to the floating platform or vessel and allowed to extend vertically into the sea or "hung off" until the storm has passed. During a conventional emergency disconnect, the system described above requires men to disconect the multilines or hoses from the riser run while hung off in a bosun's chair in a dangerous area called the "moonpool" area. The moonpool is the well exposed to the sea which surrounds the riser run and extends through the hull of the ship.

BRIEF DESCRIPTION OF THE INVENTION

Therefore, it is the primary object of the present invention to provide a riser support and connection system and method which eliminates the need to disconnect or connect multiple lines or hoses to and from a drilling or production riser run while the run is being assembled, used, hung off or retrieved.

Another object of the present invention is to provide a support and connection system which eliminates a mechanical coupling between the riser run and the platform or vessel during production operation but for the connection of hoses and cables for reducing the power required to operate the system.

Other objects of the present invention are to provide a support and connection system which is safer to operate, requires less time to operate, eliminates the need for a telescoping joint during production operation, and exposes an operator to less danger by eliminating the requirement for the operator to work in a dangerous area.

In accomplishing these and other objects, there is provided a subsea well apparatus having a riser run connected to a floating platform or vessel through a support and connection system that comprises a support housing permanently attached to the rotary table support beams which attach directly to the frame of the floating platform or vessel. Detachably connected to the support housing is a termination housing to which are connected all hoses or flow lines and tensioning cables. Mounted within the termination housing is a termination head having passageways which communicate with ports located within the termination housing that, in turn, communicate with the hoses and flow lines connected to the housing. The termination head is connected to a termination riser adapter joint which provides the mechanical connection to the uppermost riser and also provides passage for the multiple flow lines between the termination head to the uppermost riser and down to the well head.

The system thus described permits the hoses including flow lines, injection lines, sales lines, and supply and return lines to be connected to the termination housing, through the termination heads (which functions as a manifold) and then through the riser adapter to the uppermost buoyant production riser. The termination housing which mounts the termination head is sized with an opening sufficiently large enough to permit the passage of all risers and other equipment normally lowered through the vessel or floating platform to the well head at the bottom of the sea during either drilling or production operations. The hoses are permanently connected to the termination housing which receives the termination head. The termination housing connects to the support housing during assembly and retrieval and is disconnected therefrom during The drilling and production operations. Thus, it is no longer necessary to disconnect hoses for the various lines whiel assembling or retrieving the riser run. Further, should an emergency disconnect be required due to a rising storm, the support and connection system may be raised into a connected engagement with the support housing and the riser run lifted from the termination housing by removing the termination head and raising it, the adapter joint and riser run to a level where a spider may be inserted for permanently mounting the riser run upon a gimbaled platform. Throughout this operation, not a single hose need be disconnected thus speeding up the shutdown process and eliminating hazardous duty for the operators.

After a storm has subsided, the riser run may be lowered quickly into its operating position by placing the termination head into the termination housing and then disconnecting the termination housing from the support housing and lowering the riser run by tensioning means to a desired floating position. In the lowered position during a production operation, there is no mechanical connection between the riser run and the floating platform other than the hoses and cables which apply a constant tension to the production riser run. If the riser run is being used in a drilling operation, a telescoping joint is connected to the termination housing which, in turn, connects the riser run to the support housing.

Other objects and advantages of the supporting and connection system of the present invention will become apparent to those skilled in the art after consideration of the following specification and appended drawings wherein:

DESCRIPTION OF THE PREFERRED EMBODIMENT

Figure 1:
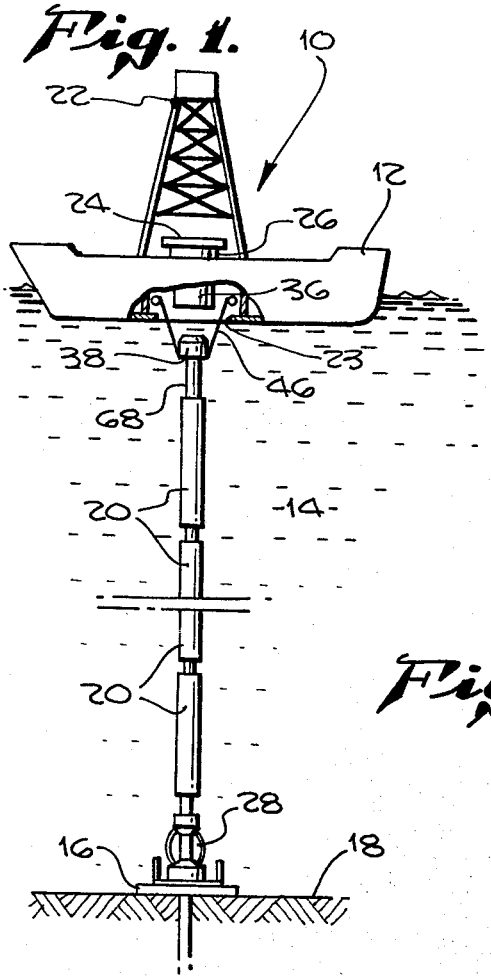
FIG. 1 is a side elevation view of a subsea well assembly including a floating platform located over a subsea well head and connected thereto by a riser run.

Referring now to the drawings, a subsea well assembly 10 is shown in FIG. 1 including a platform or vessel 12 floating upon the sea 14 over a subsea well head 16 located on the sea bottom 18. The connection between the vessel 12 and well head 16 is achieved by a plurality of buoyant riser 20 joined end-to-end and lowered into the sea from the vessel 12 by a derrick 22 mounted thereon over an opening 23, through the vessel hull, known as a moonpool.

At the base of the derrick 22 is a stationary platform 24 supported upon I-beams 26 mounted directly to the vessel's superstructure. The stationary platform 24 is provided with a large opening 27 therein for receiving and mounting a rotating table, not shown. The rotating table has a square aperture therein for driving oil well tools. Sections of the rotating table may be removed to provide access to the area below the table 24 or allow large oil well tools to be lowered by the derrick 22 therethrough into the moonpool 23 and down to the well head.

Figure 2:
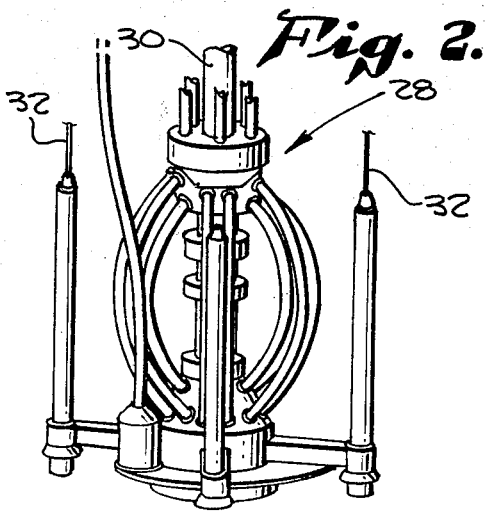
FIG. 2 is a perspective view showing a lower production riser termination.

When assembling a production riser run, for example, a lower production riser termination 28, FIG. 2, is first placed upon the platform 24 by inserting a handling tool 30 into the uppermost portion of the production riser termination 28 and lifting. The riser termination 28 is connected to cables 32 and then lowered below the platform 24 where it may be restrained from further lowering by a spider 34 shown in FIG. 7. The riser handling tool 30 is next used to raise a buoyant riser 20 into position over the riser termination 28. After the lower portion of riser 20 is bolted to the upper portion of riser termination 28, the spider 34 is removed and the two assembled risers lowered until the top of the riser 20 is aligned with platform 24 at which time the spider 34 is replaced to retain the assembled risers in the desired position.

This procedure is repeated again and again until the desired length of riser run has been established. It is not uncommon for such a riser to extend some 6,000 feet from the vessel 12 to the sea bottom 18. A similar technique is used when assembling a drilling riser run.

Figure 3:
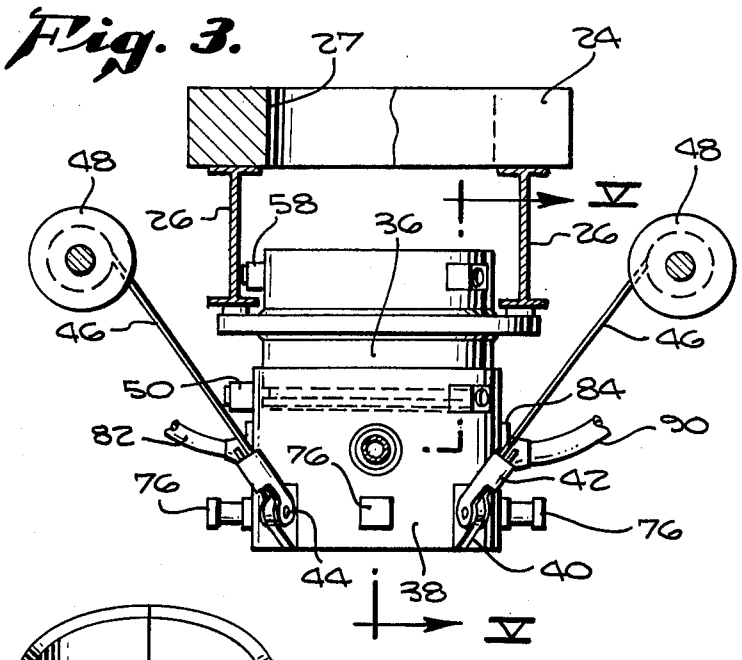
FIG. 3 is a side elevation, partially in section, showing the support housing and termination housing in the engaged position.
Figure 5:
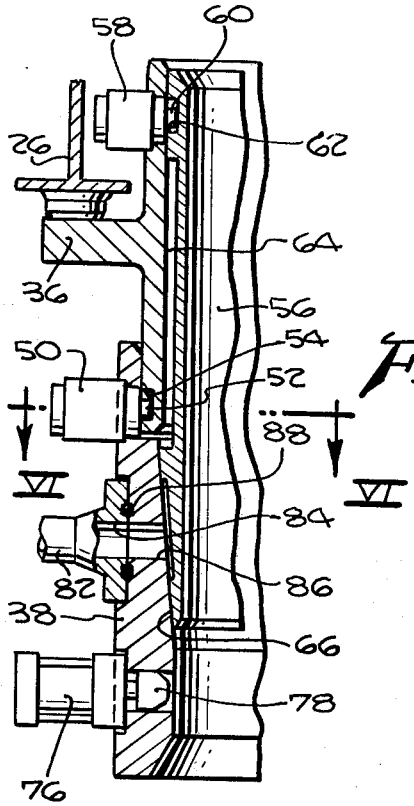
FIG. 5 is a cross-sectional view taken along lines V—V of FIG. 3.
Figure 6:
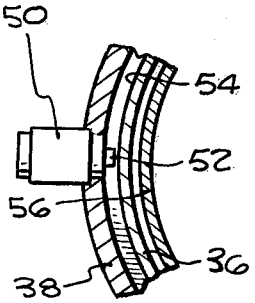
FIG. 6 is a cross-sectional view taken along lines VI—VI of FIG. 5.

As best seen in FIG. 3, the stationary platform 24 incudes a support housing 36 mounted to the lower surfaces of the I-beams 26 which, in turn, mount to the super structure of the vessel 12. Disconnectably mounted to the support housing 36 is a termination housing 38 having radially extending ears 40 to which are attached cable termination clamps 42 by pins 44. The cable clamps 42 clamp the lower end of a tension cable 42 which is wrapped around a winch pulley 48 connected to suitably driven winches, not shown. During the assembly of the production riser run, for example, the support housing 36 and termination housing 38 are locked in the position shown in FIG. 3 by a plurality of locking cylinders 50 which may be hydraulically operated to force locking pawls 52 into an annular groove 54, FIGS. 5 and 6.

Figure 4:
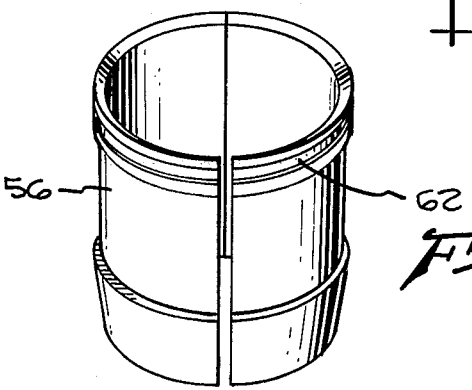
FIG. 4 is a perspective view showing a split bore protector utilized during assembly and retraction of a riser run.

Prior to lowering the first or lowermost production riser termination 28 through the opening 27 in platform 24, a split bore protection tool 56, as best seen in FIG. 4, is lowered into the connected assembly comprising the support housing 36 and termination housing 38. The split bore protector 56 is generally tubular in shape and is comprised of two semicircular halves having one end thereof joined by a hinge, not shown. The bore protector 56 is retained by a plurality of locking cylinders 58 mounted in housing 36 whose pawls 60 engages an annular groove 62 in the upper, outer surface of the split bore protector 56, FIG. 6.

The function of the protector 56 is to shield the longitudinal bore 64 of support housing 36 and the longitudinal bore 66 of termination housing 38 while the various risers 20 are inserted through the longitudinal bores of each housing. It will be noted that the longitudinal bore 64 within support housing 36 is cylindrical and generally parallel with the outer surface of that housing. However, the longitudinal bore 66 within housing 68 is generally tapered with its smaller diameter located at the lower end of the housing. This tapered surface 66 further supports the split bore protector 56.

Figure 8:
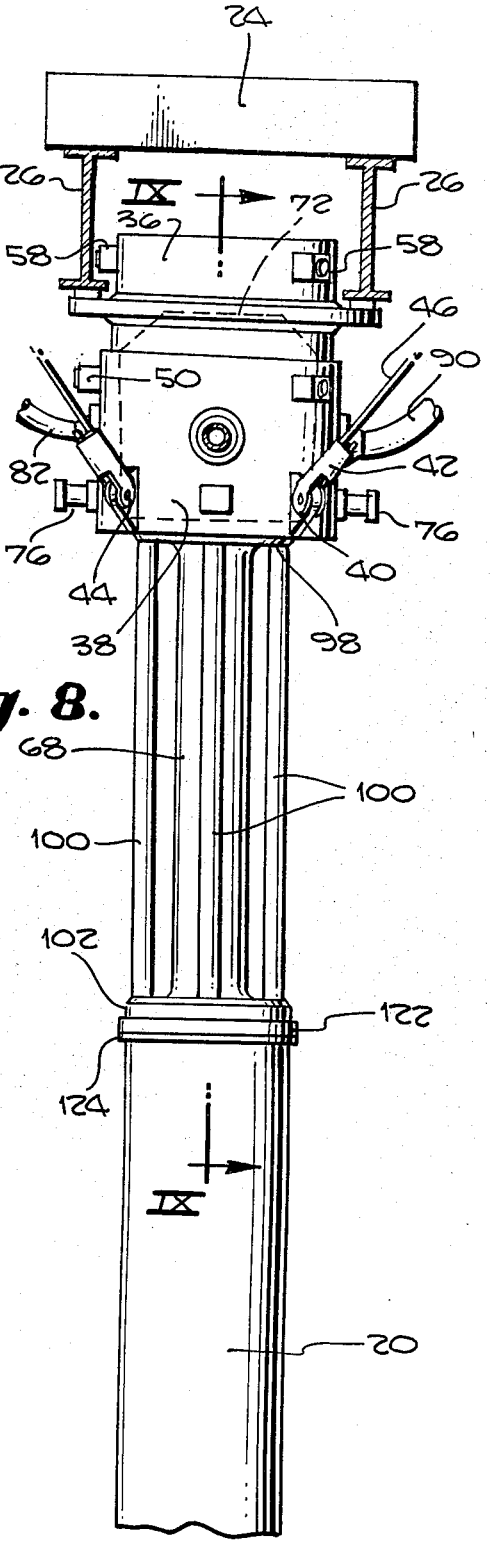
FIG. 8 is a side elevational view showing the support and connection system in engagement with the support housing prior to lowering for connection with the well head.
Figure 7:
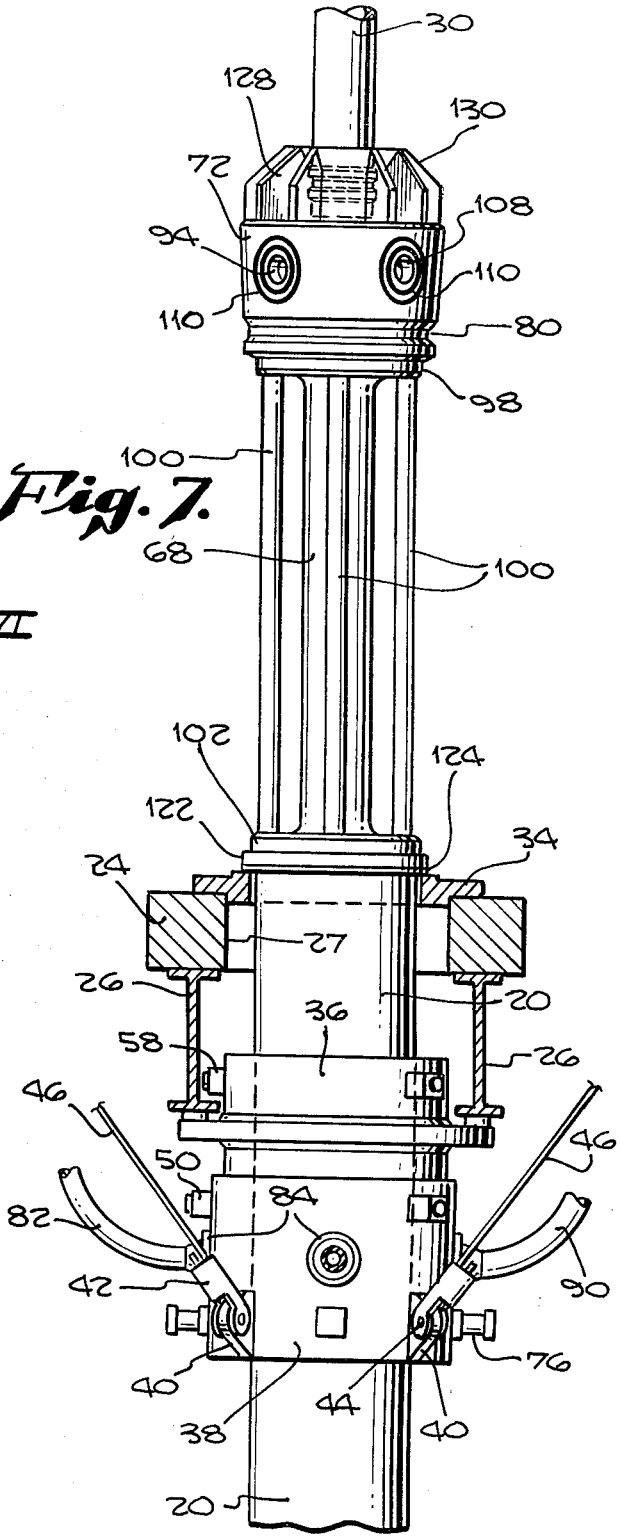
FIG. 7 is a side elevation view showing the support and connection system of the present invention in its hung off position.
Figure 9:
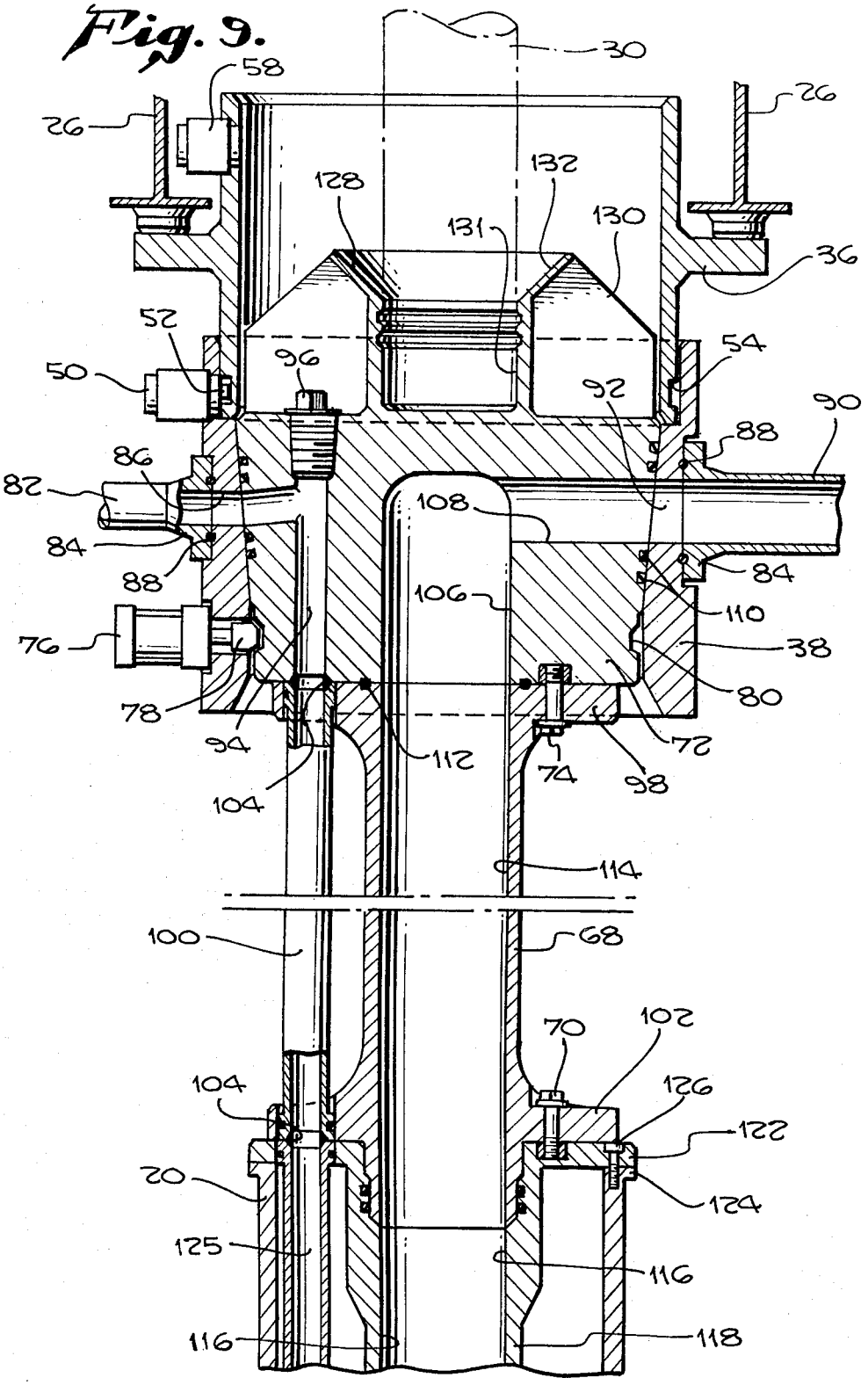
FIG. 9 is a cross-sectional view taken along lines IX—IX of FIG. 8.

After the uppermost riser 20 has been lowered through the opening 27 and retained upon the stationary platform 24 by spider 34, FIG. 7, a termination raiser adapter joint 68 is placed upon the uppermost riser and bolted thereto by a plurality of bolts 70, FIG. 9. Connected to the top of the termination riser adapter 38 is a termination head 72 connected thereto by bolts 74, FIG. 9. Once the riser adapter 68 and termination head 72 have been bolted into place, FIG. 7, the derrick 22 raises the assembled production riser tool 30 and the spider 34 is removed to enable the adapter 68 and termination head 72 to be lowered into position, FIG. 8. The outer tapered surface of the termination head 72 snuggly engages the tapered bore 66 of termination housing 38. A locking cylinder 76 is hydraulically actuated, for example, to urge pawls 78 into an annular groove 80 found within the outer surface of the termination head 72, FIG. 9.

With the termination head 72 locked into place in the termination housing 38, the production tool 30 picks up the weight of the assembled production riser and the hydraulic locking cylinder 50 is unlocked by removing hydraulic fluid pressure, for example. This permits the termination housing 38 and termination head 72 to be freed from the support housing 36 and lowered into the sea under the control of cables 46 and tensioning pulleys 48. As the cable lowers the riser assembly, the lower production riser 28 is placed in contact with the well head 16 and connection is made between the risers 20 and the well head 16 as taught in U.S. Pat. No. 4,109,712.

Figure 10:
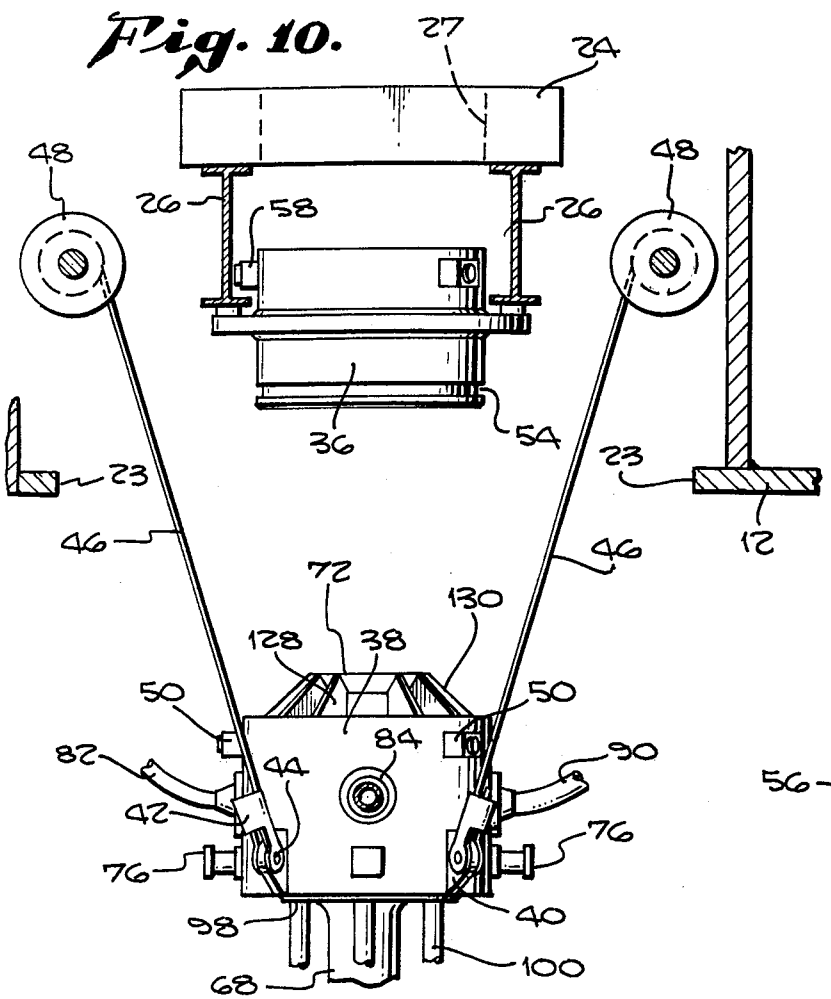
FIG. 10 is a view similar to FIG. 3 showing the support and connection system in its production operation disconnected from the support housing and lowered for connection with the well head.

As best seen in FIG. 10, the production operation of the subsea well assembly 10, assumed when the riser run 20 with its termination head 72 and termination housing 38 separates from the support housing 36, includes no mechanical connection to the vessel 12 but for the tensioning cables 46 and the connections of a plurality of lines or hoses 82. These multilines 82 include hydraulic lines which carry hydraulic fluid from the vessel 12 to the well head 16 via the risers 20. The lines include flow lines, injection lines and sales lines. Each hose 82 is connected to the termination housing 38 by a suitable hose connector 84. Radiating from the tapered bore 66 of the termination housing 38 are a plurality of ports 86, FIG. 9, which communicate with the hydraulic hose connectors 84 which are mounted upon the outer surface of the housing 38 and are sealed thereto by suitable seals, such as O-rings 88. In the embodiment shown, only four hydraulic hoses 82 and connectors 84 are illustrated for simplicity. In the preferred embodiment, twelve or more lines or hoses may be connected to the termination housing 38. At least one of the multilines may be larger than the others to form, for example, a sales outlet line 90. The sales outlet line 90 also connects through a connector 84 sealed to the outer surface of the termination housing 38 by O-rings 88 and communicates to the tapered inner surface 66 via a port 92.

Once in place, the termination head 72 acts as a manifold in that it is provided with a plurality of passageways 94 which are aligned with and communicate with the ports 86 and 92 found within the termination housing 38. A typical passageway 94, FIG. 9, communicates with port 86 and is formed in a T rotated 90° with the leg of the T extending horizontally to communicate with port 86. The top of the T of passageway 94 is vertically aligned with one end closed by a plug 96 having a pipe thread for sealing the passageway 94. The other end of passageway 94 communicates through a top flange 98 in the raiser adapter 68 with a flow line 100. The flow line 100 mounts between the top flange 98 and a bottom flange 102 and is secured within each flange by welding or a threaded insert. It will be understood that each passageway 94 wihtnin the termination head 72 communicates with a flow line 100 mounted between flanges 98 and 102 within adapter riser 68.

Each passageway 94 is sealed to a flow line 100 by seals 104. These same seals are used to seal the lower surface of the adapter 68 against the upper surface of the uppermost riser 20. The center of termination head 72 is provided with a vertical bore 106 which does not pass completely through the termination head 72. A horizontal bore 108 communicates with bore 106 to create a passageway which communicates with the sales outlet line 90. A pair of seals 110, such as a packer seals, surround the passageways 94 within the termination head 72 and also surround the bore 108 for sealing the passageways and bore as the termination head 72 is mounted into the termination housing 38. Similarly, a single seal 112 surrounds the bore 106 to seal that passageway against the upper surface of the adapter 68. Adapter 68 is provided with a longitudinal bore 114 which communicates between the termination head bore 106 and a center bore 116 within the cylindrical tube 118 which forms the center of riser 20.

The cylindrical tube 118 is surrounded by a second cylindrical wall 120 which forms the outer portion of the buoyant riser 20 wherein the gas that provides the buoyancy for the riser is trapped between the outer surface of tube 118 and the inner surface of shell 120. The upper end of tube 118 comprises an outwardly directed flange 122 which is concentrically aligned with an outwardly directed flange 124 formed on the upper end of shell 120. A plurality of tubes 125 are mounted between flanges 122 and 124 and a similar set of flanges at the lowermost end of each riser 20 to communicate between the vessel 12 and well head 16 via flow lines 100 and hoses 82 and 90. A ring of bolts 126 may be used to join the tube 118 to shell 120. The bolted flange formed by flanges 122 and 124 is the flange under which the spider 34 is placed to retain the riser assembly in the position shown in FIG. 7.

It will be understood that the outer diameter of flanges 122 and 124 must be small enough to fit through the inner diameter of the split bore protector 56, FIG. 4, and bores 64 and 66 of support housing 36 and termination housing 38, respectively. The bolts 70 which pass through the lower flange 102 of the adapter 68 are threadably mounted within the flange 122 formed on the riser 20 to connect the adapter 68 to the riser 20.

As seen in FIGS. 9 and 10, the upper end of the adapter head 72 is provided with a webbed mating portion 128 whose upper surface has been tapered at 130. The taper 130 assists in aligning the locked assembly of the termination housing 38 and termination head 72 with the support housing 36 as the termination housing and head is raised into position under the support housing. Once the termination housing has been raised into the proper position by the winching action of pulleys 48 and cable 46, the hydraulic locking cylinders 50 mounted on housing 38 are actuated to urge pawls 52 in to groove 54 in housing 36. An inner aperture 131 of the webbed portion 128 is provided with an inwardly directed taper 132 which provides an aligning seat as the production riser handling tool 30 is inserted into aperture 131.

An alternate configuration to that shown in FIG. 9 may be accomplished by removing plugs 96 and arranging the passageways 94 with vertical access to the top of the termination head 72, FIG. 9. The flow lines 100 which extend through each riser section 20, as shown by riser flow line 125, may be closed at the lowermost production riser by a plug valve which is actuated into an open condition by tensioning a wire line. Using this arrangement, individual flow lines may be pressurized and tested while the risers 20 are being assembled.

The riser run described until now has been described as a production riser. It will be understood that a drilling riser may also be used with the present invention. When a drilling riser is used, the riser is not permitted to float free of the platform. Rather, a telescoping section, not shown, similar to the section described in U.S. Pat. No. 3,952,526 is connected between the termination housing 38 and support housing 36. The upper most end of the telescoping section is provided with a blowout-preventer, such as that shown in U.S. Pat. No. 3,791,442, which fits into the bore 64 of support housing 36. During a drilling operation, the cable tension system formed by cables 46 retains the riser run in the vertical position desired while the telescoping section absorbs the vertical displacement between the platform and the well head 16 on the sea floor. After initial connection, the multilines connected to the termination housing 38 need not be disconnected therefrom during assembly, use or while hung off or retrieved.

The unique method of connecting a riser run and supporting that run during its operation may now be described with reference to the foregoing drawings. It will be understood that the method described is described as if a production riser and production operation were involved; however, the method is the same for a drilling riser and drilling operation unless otherwise noted.

During assembly, the termination housing 38 is raised by tension cables 46 and locked by hydraulic cylinders 50 to the support housing 36. Hoses 82 and 90 including flow lines, injection lines and sales lines are then connected to the housing 38. The split bore protector 56 is then installed within the support housing 36 and termination housing 38 and locked into position by hydraulic locking dogs 58. Next, the production riser termination 28 is lowered through the bore within the protector 56 and landed upon the spider 34. A production riser 20 is then attached to the production riser termination 28 and the two are lowered through the stationary table 24, support housing 36 and termination housing 38 landing the flanges 122 and 124 of riser 20 on the riser spider 34 positioned above the stationary table 24. Each additional riser 20 is attached in a similar manner until the desired length has been extended into the sea whereupon the split bore protector 56 is removed. Next, the riser adapter joint 68 and the termination head 72 are assembled and raised with the production handling tool 30 over the uppermost production riser 20 where the last joint is made fast by insertion of bolts 70. The assemblied riser run is then lowered until the termination head 72 lands in the tapered bore 66 of termination housing 38 and is locked in place by hydraulic locking dogs 76. The weight of the production riser run 20 is then lifted from the stationary table 24 with tool 30 prior to unlocking the support housing 36 by deactivating the hydraulic locking dogs 50. Lastly, the production riser run 20 including the disengaged termination head 72 and termination housing 38 is lowered until the weight is taken by tensioning cables 46. Thereafter, the lowering continues with the weight on the tension cables until the lower production riser termination 28 lands on and engages the well head 16.

It will now be seen that production of the subsea well 10 may continue with no mechanical connection between the vessel 12 and riser run 20 but for the tensioning cable 46 and hoses 82 and 90. This eliminates the need for telescoping joints and substantially reduces the amount of energy needed to operate the winch pulleys 48.

If a drilling riser is assembled, an additional step of placing a telescoping section atop the riser adapter joint 68 is required. When the termination housing 38 and termination head 72 are disengaged from the support housing 36 and lowered, the telescoping section is lowered with them until its upper section lands in the support housing 36.

During production or drilling operations, should a storm create the necessity to disconnect the riser run 20 from the well head 16, the method of operation is as follows: first, the handling tool 30 is installed in the aperture 131 of the termination head 72; second, the riser is released from its connection at the well head 16 and the riser run 20 is pulled in a vertical direction with the handling tool 30 until the termination housing 38 engages the support housing 36; third, the hydraulic locking dogs 50 are actuated to lock the termination housing 38 to the support housing 36; fourth, the four locking dogs 76 that lock the termination head 72 to the termination housing 38 are released; and, finally, the pulling of the riser 20 continues until the uppermost riser 20 has been pulled so that its flange 122–124 can be landed on the spider 34 resting on the platform 24 which, in turn, mounts upon energy-absorbing gimbals. Through this arrangement, the riser run 20 may be disconnected from the well head 16 and placed in the hung off position without the need for disconnecting a single hose or exposing personnel to a dangerous work area in bosun's chairs over the moonpool.

Should it be desired to recover the remaining portion of the riser run 20, this may be accomplished by continuing to pull the riser run until the uppermost riser clears the table 24 whereupon the protector 56 may be installed within the support housing 36. The remaining portions of the riser run 20 are is recovered in the conventional manner through the table 24 utilizing the riser spider 34.

As the riser run 20 is assembled back into its production or drilling configuration, it will be understood that the termination head 72 is lowered snuggly into the termination housing 38. In this position, the seals 110, which are packer type seals permanently fixed within the tapered surface of the termination head 72, seal the passageways between the hoses 82 and 90 and the riser adapter 68. Thus, it will be seen that the hoses 82 and 90 permanently connected to the outer surface of the termination housing 38 are automatically disconnected by the disconnection and rising of the termination head 72. Utilizing this arrangement, it is possible to make and break all hydraulic connections without the need for manually disconnecting a single connector 84.

While the present invention has been described utilizing a separate support housing 36 and a separate riser adapter 68, it will be understood that the support housing may be built into the platform 24 as a permanent member thereof and need not be considered a separate piece. Similarly, the riser adapter may be built into the termination head and need not be a separate piece. Other modifications and variations of the present invention will become apparent to those skilled in the art after considering the following claims:

I claim:

1. In a support and connection system for a subsea well having a multiline riser run in sections from a floating platform to said subsea well including an uppermost riser, the improvement comprising: support housing means mounted upon said platform; termination means disconnectably mounted within said support housing means for supporting said uppermost riser of said multiline riser run depending therefrom and having passageways communicating with said multilines within said riser; hose means connected to said termination means for communicating with said passageways; and means for disconnecting said termination means from said uppermost riser while retaining said hose means connected to said termination means; whereby assembly, hang off and recovery operations may be conducted without connecting and disconnecting said hose means.

2. In a support and connection system for a subsea well having a multiline riser run in sections from a floating platform to said subsea well including an uppermost riser, the improvement comprising: terminating means for supporting said uppermost riser of said multiline riser run depending therefrom and including termination head means having passageways communicating with said multilines within said riser, and termination housing means having a central bore for receiving said termination head means and ports communicating with said passageways; hose means connected to said ports in said termination housing means; and means mounted within said termination housing means for disconnecting said termination head means from said termination housing means; wherein said multiline riser run may be separated from said termination housing means without disconnecting said hose means.

3. In a support and connector system, as claimed in claim 2, wherein said means for disconnecting said termination housing means from said termination head means includes hydraulic latching means.

4. In a support and connection system for a subsea well having a multiline riser run in sections from a floating platform to said subsea well including an uppermost riser, the improvement comprising: termination means for engaging said uppermost riser of said multiline riser run having passageways communicating with said multilines within said riser; support housing means disconnectably mounting said termination means; hose means connected to said termination means for communicating with said passageways; means for disconnecting said termination means from said support housing means; and means for disconnecting said termination means from said uppermost riser while retaining said hose means connected to said termination means; wherein said termination means may be disconnected from said support housing means and said riser run may be disconnected from said termination means without disconnecting said hose means.

5. In a support and connection systems for a subsea well having a production riser run in sections from a floating platform to said subsea well including cable means, hose means, and an uppermost riser, the improvement comprising: means for engaging said uppermost riser of said production riser run to said platform during assembly, hang off and recovery operations; and means for floating said uppermost riser of said production riser run vertically spaced from and free of mechanical connection with platform supported components other than cable means and hose means connections during production operation.

6. In a support and connection system for a subsea well having a multisectional production riser run from a floating platform to said subsea well, the improvement comprising: support hosing means mounted to said platform; termination housing means disconnectably engaging said support housing means and engaging an uppermost riser of said riser run; hose means connected between said termination housing means and said platform; tensioning means connected between said termination housing means and said platform; and means for rising said termination housing means into connected engagement with said support housing means and lowering said termination housing means from said connected engagement wherein the only connection from said uppermost riser through said termination housing means to said platform in said lowered configuration is via said hose means and said tensioning means.

7. In a support and connection system for a subsea well having a multisectioned riser run from a floating platform to said subsea well, the improvement comprising: a support housing mounted upon said platform; a termination housing disconnectably engaging said support housing; a termination head removably mounted within said termination housing; said termination head including adapter means for coaxially engaging an uppermost section of said riser run; hose means connected between said termination housing and said platform; tensioning means connected between said termination housing and said platform; and means for rising said termination housing into connected engagement with said support housing and for lowering said termination housing from said connected engagement wherein said hose means remain connected to said termination housing.

8. In a support and connector system for a subsea well having a multisectional riser run, as claimed in claim 7, wherein: said termination housing includes a longitudinal bore whose lower, inner surface is tapered; said termination head includes a tapered outer, lower surface for engaging said bore in said housing; and said termination head further includes a tapered outer, upper surface for engaging said support housing means; wherein said tapers act as a guide as said termination head engages said termination housing and support housing.

9. In a support and connection system for a subsea well having a multisectioned riser run from a floating platform to said subsea well, the improvement comprising: a support housing mounted upon said platform; a termination housing disconnectably engaging said support housing; said termination housing includes a longitudinal bore having radially directed ports extending through said termination housing and radially directed ears extending from said termination housing; a termination head removably mounted within said longitudinal bore of said termination housing having passageways therethrough which align with said radial ports; said termination head including adapter means for coaxially engaging an uppermost section of said riser run; said adapter means having passageways therethrough which communicate between said passageways in said termination head and said uppermost riser section; connector means mounted upon said termination housing for communicating with said ports; hose means connected between said connector means and said platform; swivel connector means mounted upon said ears; tensioning means connected between said swivel means and said platform; and means for rising said termination housing into connected engagement with said support housing and for lowering said termination housing from said connected engagement wherein communication between said platform and said subsea well through said hose means, connector means, termination housing ports, termination head passageways, adapter means passageways and riser run is uninterrupted whether said riser run is raised into connected engagement with said support housing upon said platform or lowered free thereof.

10. A method of supporting and connecting a floating platform to a subsea well via a multiline, multisection riser run, comprising the steps of: raising a termination housing into locking engagement with a support housing within said floating platform, using tensioning cables; connecting hoses to said termination housing; lowering a riser termination through said support housing and said termination housing; attaching the lower end of a first riser to said riser termination and lowering said first riser through said support housing and said termination housing; attaching a plurality of risers to said last mentioned riser and lowering said plurality of risers until the desired length of riser run has been extended; connecting a termination head to a riser adapter joint and placing said assembled riser adapter joint and termination head upon the uppermost riser; lowering said assembled riser adapter and termination head through said support housing and said termination housing until said termination head engages with and locks to said termination housing; unlocking said engagement between said support housing and said termination housing and lowering said termination housing, termination head, adapter, multisection riser run, and riser termination by said tensioning cables to land said riser termination upon said subsea well and make connection therewith.

11. A method, as claimed in claim 10, additionally comprising the step of: inserting a split bore protector to protect said support housing and termination housing before lowering said riser termination or said plurality of risers; and removing said protector before lowering said adapter and terminating head.

12. A method, as claimed in claim 11, additionally comprising the steps of: disconnecting said riser termination from said subsea well; pulling said termination housing, termination head, adapter, multisection riser run and riser termination until said termination housing engages said support housing and is locked thereto; unlocking said termination head from said termination housing; pulling said termination head, adapter, multisection riser run and riser termination until said uppermost riser may be secured without disconnecting said hoses from said termination housing.

13. A method, as claimed in claim 12, additionally comprising the steps of: pulling said uppermost riser fully above a point where it may be secured, inserting said split bore protector to protect said support housing and termination housing; and pulling the remaining plurality of risers and said riser termination.

14. A method, as claimed in claim 13, wherein said riser run is a production riser and said riser termination is a production riser termination.

15. A method, as claimed in claim 13, wherein said riser run is a drilling riser and said riser termination is a drilling riser termination.

* * * * *